United States Patent [19]

Ocampo

[11] 4,324,406

[45] Apr. 13, 1982

[54] BOARD GAME METHOD

[76] Inventor: Joseph D. Ocampo, 2437 Warring - Apt. D, Berkeley, Calif. 94704

[21] Appl. No.: 138,100

[22] Filed: Apr. 7, 1980

[51] Int. Cl.[3] ..... A63F 3/00

[52] U.S. Cl. ..... 273/242; 273/272

[58] Field of Search ..... 273/272, 242, 243; 434/189, 188

[56] References Cited

U.S. PATENT DOCUMENTS

| | | | |
|---|---|---|---|
| 604,401 | 5/1898 | Lang | 273/242 |
| 1,591,639 | 7/1926 | McDonald | 273/242 |
| 1,666,359 | 4/1928 | Steves | 273/267 |
| 3,075,771 | 1/1963 | Dodge | 273/275 |
| 3,267,590 | 8/1966 | Browning | 273/272 |
| 3,342,493 | 9/1967 | Lang | 273/271 |
| 3,659,851 | 5/1972 | Lang | 273/271 |
| 3,663,021 | 5/1972 | Whippo | 434/189 X |
| 3,744,153 | 7/1973 | Vanes | 273/272 |
| 3,863,929 | 2/1975 | Kahan | 273/275 |
| 3,897,953 | 8/1975 | Hoynanian | 273/258 |
| 3,918,715 | 11/1975 | Puglis | 273/261 |
| 4,036,501 | 7/1977 | Hovanian | 273/258 |
| 4,258,922 | 3/1981 | Landry | 273/272 X |

FOREIGN PATENT DOCUMENTS

| | | | |
|---|---|---|---|
| 244201 | 3/1912 | Fed. Rep. of Germany | 273/242 |
| 353871 | 9/1905 | France | 273/242 |
| 532758 | 3/1921 | France | 273/242 |

*Primary Examiner*—Richard C. Pinkham
*Assistant Examiner*—Scott L. Brown
*Attorney, Agent, or Firm*—Limbach, Limbach & Sutton

[57] ABSTRACT

A board game in which pieces bearing the numbers "one" and "zero" are moved into juxtaposition and scoring is accomplished by forming binary numbers from adjacent sets of pieces. Preferably the pieces move differently with the number "one" pieces moving like chess bishops and the number "zero" pieces moving like chess rooks.

1 Claim, 2 Drawing Figures

BOARD GAME METHOD

BACKGROUND OF INVENTION

Figure 1:
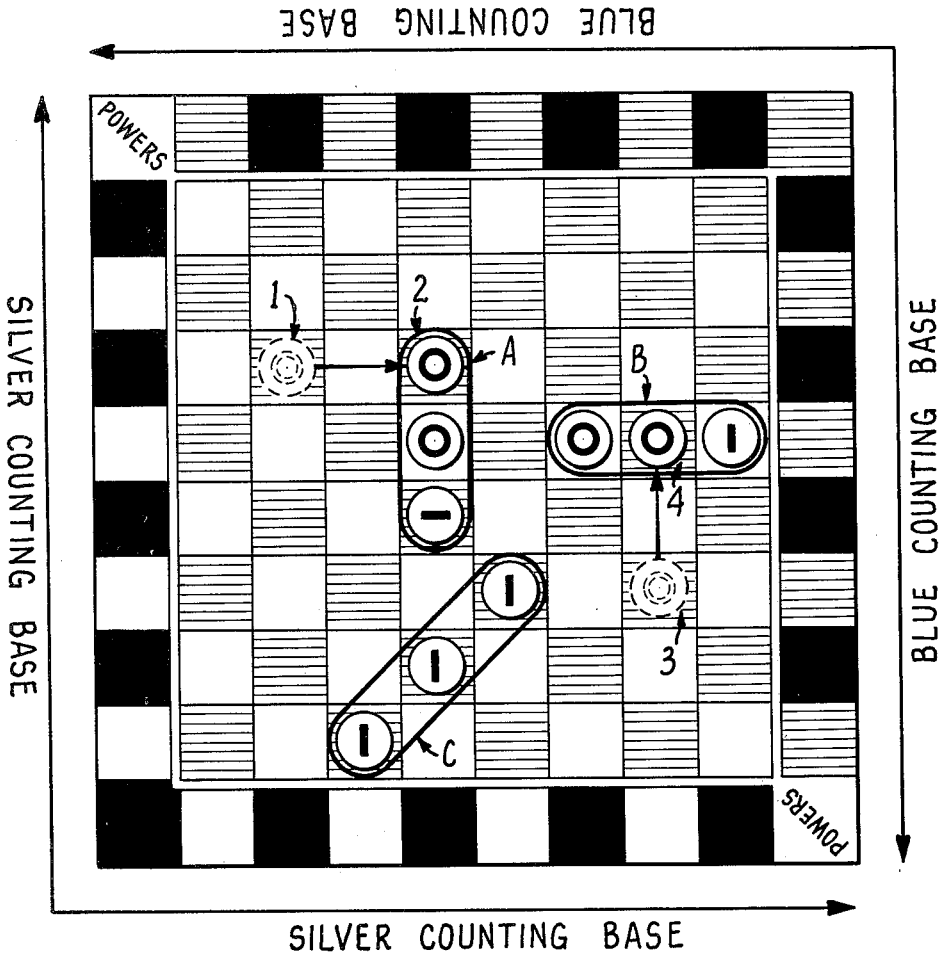

A wide variety of board games have been developed for use on boards like checker boards such as the well-known games of checkers, chess, polygon and the like, and in these known games scoring is normally accomplished by capturing opposing pieces or the like.

SUMMARY OF INVENTION

In accordance with this invention I have developed a board game in which a new and unique type of scoring is provided. During the play of the game different pieces bearing the numbers "one" and "zero" are moved into and out of relationship with each other and scoring is accomplished when they move into a relationship denoting a binary number. Additionally, the score scored by such a scoring relationship is the binary number which the adjacent pieces display.

A wide variety of games may be played with this new basic technique, and depending upon the detailed rules adopted for each variety of game, the game may have greater or lesser complexity. The following features are basic game rules which may be employed singularly and in combination in these various varieties of the basic game:

1. The game may be played on a checker board type of board of either the standard 8×8 size or different size, and it may be played on a three-dimensional board.

2. The different numbered pieces move in different manners, for instance, the number "one" pieces move on the diagonal, like chess bishops, and the number "zero" pieces move in ranks and files, like chess rooks.

3. Play is started from a line of squares on at least one side of the board, and the pieces occupying the starting squares do not participate in a scoring count.

4. A strategic part of the game may be the placement of the pieces on the board, as if a part of the game of chess included each player deciding whether to initially place his bishop in the third square from the corner or in the corner.

5. A score may include the sum of multiple binary numbers which are made up in different directions by the movement of a single piece.

6. The binary number which is formed for a score is a different number viewed by the different players so that if a particular combination of pieces if formed by one player, it might score 4 for the binary number 100, whereas, the same combination of pieces formed by the other person would score 1 for the binary number 001.

7. Very unique forms of the game can be made where one player or team plays from two perpendicular sides of a square checker board at the same time changing the player's perspective of the board dramatically.

8. The rules may provide that a piece can jump over another piece, but the strategy in the game is improved where the rules provide that one piece can neither jump over another piece nor capture another piece.

9. Scoring may be provided for fixed or variable lengths of binary numbers, but preferably scoring is limited to small fixed length binary numbers, such as the binary numbers 0 through 7.

10. Termination of the game can be provided in a number of ways, such as, a predetermined number of moves, a predetermined number of scores, or a predetermined score.

11. The pieces which score by their proximity to others may have representations other than "one" and "zero". For instance, the pieces could carry the representations "zero", "one" and "two", with scoring accomplished with numbers in the base three.

Figure 2:
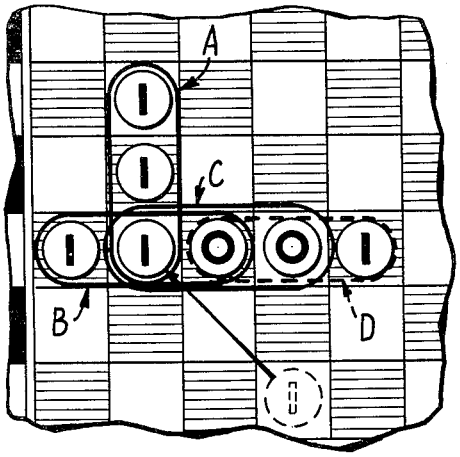

Many features and advantages of the game will be apparent from the following description of a preferred embodiment of the game called POWERS read in conjunction with the attached drawings in which:

FIG. 1 is a plan view of the game board with exemplary moving tiles on the board, and FIG. 2 is a plan view of a part of the board illustrating one move and scoring.

POWERS is a game of strategy in which success is determined by a team's ability to score quickly and maximize the points scored in each set. POWERS can be played by two or four people and can last thirty minutes or more, depending on the number of sets played. POWERS can be enjoyed at any level of playing experience and is as challenging as the players are skillful.

EQUIPMENT

GAME BOARD: The game board for POWERS has a total of 100 squares. The outer most 36 squares or peripheral playing area are used for the opening moves. Here the players place their scoring pieces on the board. Each team will be limited to two edges between the corner squares marked POWERS for scoring piece placement. After the scoring pieces are on the peripheral playing area, the pieces will be moved onto the main playing field or middle 64 squares where they will be moved into scoring triplets.

SCORING PIECES: Each team receives eight scoring pieces; four "ones" and four "zeros". If four people are playing, teams of two people each, must be chosen. Two of the "ones" and two of the "zeros" for each team are marked with a dot to differentiate one player's pieces from his partners. During the game, each player is allowed to move only his own pieces. If two people are playing, each person has eight pieces to move and if four are playing, each team member has control over four pieces.

SCORING

POWERS scoring system is called an octal-binary based number system. Each number is three digits long, no more and no less. The digit to the farthest right in the sequence of three has the value of $2^0$ power which equals 1. Therefore, if a "one" scoring piece is the first in the sequence from the right, the player adds one point to the score since $2^0 \times 1 = 1$. If a "zero" scoring piece occupies this first digit in the triplet, zero is added to the score since $2^0 \times 0 = 0$. The middle digit has the value of $2^1$ power. Therefore, if a "one" scoring piece is the second digit of the sequence, two is added to the score since $2^1 \times 1 = 2$. If a "zero" scoring piece is the middle digit there is no addition to the score since $2^1 \times 0 = 0$. The left digit in the triplet has the value of $2^2$ power. A "one" scoring piece on the left allows the player to add four points to the score since $2^2 \times 1 = 4$. A "zero" scoring piece in this position again has a zero value since $2^2 \times 0 = 0$. A total score for a turn is the sum of values for each digit in the triplet.

An example of a scoring triplet:

| 0 | 1 | 1 | |
|---|---|---|---|
| $2^2 \times 0$ | $2^1 \times 1$ | $2^0 \times 1$ | |
| $2 \times 2 \times 0$ + | $2 \times 1$ + | $1 \times 1$ | = 3 total score |
| 0 | 2 | 1 | |

The following are the possible scoring triplets:

| | | | |
|---|---|---|---|
| 000 = 0 | 010 = 2 | 100 = 4 | 110 = 6 |
| 001 = 1 | 011 = 3 | 101 = 5 | 111 = 7 |

Notice that the scoring triplet consisting of three "zero" scoring pieces in sequence does count as a score of zero.

To score in POWERS, a player moves a scoring piece into a position which forms a sequence of three scoring pieces along a row or column. The other scoring pieces in the triplet can be either the player's or his opponent's. The value of the score is computed according to the octal-binary based number system described above and with reference to the player's counting base. Refer to FIG. 1 while reading the following examples.

Consider the three pieces circled and labeled A. If the "zero" scoring piece that moved from square 1 to square 2 was from the silver team, the score equals one. The "one" piece is in the $2^0$ digit space when the silver team reads the score over from the silver counting base. If the "zero" piece that moved from square 1 to square 2 was from the blue team, the score in circle A equals four. The "one" piece is in the $2^2$ digit space when the blue team reads over from their counting base.

Consider the three pieces circled and labeled B. If the "zero" scoring piece that moved from square 3 to square 4 was from the silver team, the score equals one. The "one" piece in the triplet is in the $2^0$ digit space when read up from the silver counting base. If the "zero" piece in circle B that moved from square 3 to square 4 was from the blue team, the score equals four. The "one" piece is in the $2^2$ digit space when read down from the blue counting base.

Notice the three pieces circled and labeled C. These pieces are along the diagonal and cannot be considered as a scoring triplet.

Multiple scores are possible. If a player moves a scoring piece into an arrangement of other scoring pieces and forms more than one triplet, the score is the total of all the triplets involving the piece moved during that turn. An example of multiple scoring is shown in FIG. 2

Triplet A scores 7 points
Triplet B scores 6 points
Triplet C scores 4 points
total score 17 points Notice Triplet D does not contribute to the score since it does not contain the piece moved. There is no penalty for not scoring during a turn.

After a player or a team has scored ten times, the set is over. No further scores can be added to either team's scores from this set. After a set is over, each team totals its scores to arrive at the set score. The board is cleared and play begins again with placement of scoring pieces. The number of sets in a game is variable.

OPENING MOVES

The first part of the game is played only on the outermost squares. The two squares marked POWERS are not considered part of the playing board. Each player (if two are playing) or team has two edges to place pieces on. One team can place their eight pieces on any of the 17 squares of alternating blue and black. The opposing team places their eight pieces on the 17 squares of alternating silver and black. These edges will be the players' scoring or counting base throughout the game. A player develops his strategy for scoring and blocking in the set through the placement of scoring pieces on the peripheral squares. Although pieces cannot move within the peripheral area, the scoring pieces exit and move on the main playing field in two different ways. "One" scoring pieces move along diagonals and must leave the peripheral squares along diagonals. "Zero" scoring pieces move along rows and columns and must leave the peripheral squares in the row or column it was initially placed in. Other rules governing placement and subsequent movement of pieces are listed in the RULES OF PLAY section.

To start play, a member of one team places a scoring piece on one of his peripheral squares. In the following set a member of the other team will be first to place a scoring piece on the board. After the first team has placed one piece, the second team plays one piece on their outer squares. If two people are playing, they alternate setting pieces on the board. If four are playing, they alternate setting pieces on the board between the teams and partners so that each player plays once before any have a chance to play twice. After all sixteen scoring pieces are placed on the peripheral squares, players can move their scoring pieces onto the main playing field and into scoring triplets. Players continue to take turns in the same alternating pattern used during scoring piece placement. A player can claim scores and move pieces only during his turn. All moves and scores must be in accordance with the RULES OF PLAY. Once moved, a scoring piece can be moved again in another turn. A player does not have to move all of his scoring pieces out of the peripheral squares although pieces in peripheral squares cannot be used in a scoring triplet. Once a team scores ten times, the set is over and the board is cleared to start a new set.

RULES OF PLAY

STARTING THE GAME

1. The corner squares marked POWERS are not considered part of the playing board and therefore cannot be used to place scoring pieces on.
2. Scoring pieces will be placed on the board in an alternating fashion between the opponents and between members of teams, if four are playing.
3. Each player can place a scoring piece on any square within the two edges which are his counting base.
4. Once placed on the board, a scoring piece cannot be moved while in the peripheral squares. The scoring piece can only be moved onto the playing field.
5. No piece can be moved onto the playing field until all scoring pieces on both teams have been placed on the board.
6. Once on the playing field, a scoring piece cannot move back onto peripheral squares.
7. No scoring piece on a peripheral square can be considered part of a triplet when computing a score.

MOVING AND SCORING

1. Each player is allowed to move only his own scoring pieces and can move one piece each turn.

2. "Zero" scoring pieces enter and move along the columns and rows of the main playing field.

3. "One" scoring pieces enter and move along the diagonals, remaining on the same colored squares throughout the set.

4. Scoring pieces may be moved any number of squares along a straight path and can be moved as often as desired during the game.

5. No piece can jump over another piece. No piece can occupy the same square as another piece. No scoring piece can knock another piece out of a square.

6. Three scoring pieces must be used in computing a score.

7. A scoring triplet must contain the piece moved on that turn.

8. Multiple scores are possible but each scoring triplet must contain the piece moved during that turn.

9. Three scoring pieces in line on a diagonal cannot be counted for a score.

10. Scoring pieces in a triplet counted for a score must be in neighboring squares.

11. The first team to accumulate ten scores ends the set and stops any further play or scoring in that set.

This form of game of my invention, POWERS, provides a great deal of strategy and a substantial amount of skill which may be developed in the learning mode of playing the game repeatedly.

It will be obvious that many modifications of the basic rules of the game may be made without departing from the scope of the following claims.

Games can be made much more complex where, for instance, it is played on a three-dimensional board as mentioned above. A suitable simpler form of the game may be played on a standard checker board where each player has eight pieces, four "ones" and four "zeros", and, of course, any symbol may be used on the pieces to denote the "one" and the "zero". This simplified form of the game is played by the following rules:

1. "One" pieces move on the diagonal and "zero" pieces move like chess rooks, as in POWERS.

2. Each player's pieces are initially placed in his king's row with the "zeros" in the four center squares and the "ones" in the outer squares.

3. Play proceeds as in POWERS, but scoring is done viewing the numbers only in the direction facing the player's opponent.

4. The game is won when a player's cumulative score reaches 31, binary 11111.

What is claimed is:

1. A method of playing a game adapted to be played on a board, which comprises the steps of:

each player or team placing a set of markers, each marker containing a single digit and at least two different digits in each set, on the individual marker locations;

assigning a reading direction or directions to each player or team in relation to the playing surface, the direction or directions being different for each player or team;

sequentially moving the markers to individual marker locations;

positioning a plurality of markers adjacent to one another forming a multidigit number, with each digit of the multidigit number formed from a single marker;

separately reading in the players assigned direction each of the plurality of markers forming the multidigit number;

recording as a score the multidigit number that was read.

* * * * *